US005217358A

United States Patent [19]

Mori et al.

[11] Patent Number: 5,217,358

[45] Date of Patent: Jun. 8, 1993

[54] SCROLL TYPE COMPRESSOR WITH ELONGATED DISCHARGING PART

[75] Inventors: Tatsushi Mori; Tetsuhiko Fukanuma; Yuji Izumi; Tetsuo Yoshida, all of Kariya, Japan

[73] Assignee: Kabushiki Kaisha Toyoda Jidoshokki Seisakusho, Kariya, Japan

[21] Appl. No.: 829,978

[22] Filed: Jan. 31, 1992

[30] Foreign Application Priority Data

Feb. 19, 1991 [JP] Japan ..... 3-6934[U]

[51] Int. Cl.[5] ..... F04C 18/04; F04C 27/00

[52] U.S. Cl. ..... 418/55.2; 418/55.4; 418/142

[58] Field of Search ..... 418/55.1, 55.2, 55.4, 418/142

[56] References Cited

U.S. PATENT DOCUMENTS 4,464,100 8/1984 Machida et al. ..... 418/55.1
4,547,137 10/1985 Terauchi et al. ..... 418/55.2
4,645,436 2/1987 Sakamoto ..... 418/55.2
5,022,834 6/1991 Etemad et al. ..... 418/55.1

FOREIGN PATENT DOCUMENTS 62-118082 5/1987 Japan ..... 418/142
63-215891 9/1988 Japan ..... 418/55.1
1-187390 7/1989 Japan ..... 418/55.2

*Primary Examiner*—John J. Vrablik
*Attorney, Agent, or Firm*—Brooks, Haidt, Haffner & Delahunty

[57] ABSTRACT

In a scroll type compressor, a discharging port in a side plate of a stationary scroll member is formed in an elongated shape, such as an oval, so that a tip-seal element provided in the beginning area of a movable spiral body does not interfere with the discharging port in the course of an orbital motion, whereby damage to the tip-seal element due to a draw-in thereof to the discharging port can be avoided, while ensuring a sufficient fluid pressure and full sealability.

4 Claims, 6 Drawing Sheets

SCROLL TYPE COMPRESSOR WITH ELONGATED DISCHARGING PART

BACKGROUND OF THE INVENTION

1. Field of the Invention

The present invention relates to a scroll type compressor, particularly to an improvement of the sealability for a beginning area of a spiral body in a movable scroll member and an improvement of a discharging port of a stationary scroll member in the compressor.

2. Description of the Related Arts

As shown in FIG. 6, the conventional scroll type compressor comprises a stationary scroll member 52 fixed in a housing 51, and a movable scroll member 53 rotatably accommodated in the housing 51. The stationary scroll 52 member consists of a stationary side plate 21 and a stationary spiral body 22 comprising outer and inner walls defined, respectively, by an involute curve or other and integrally fixed on one surface of the stationary side plate 21. The movable scroll member 53 consists of a movable side plate 31 and a movable spiral body 32 comprising outer and inner walls defined, respectively, by an involute curve or other and integrally fixed on one surface of the side plate 31, both spiral bodies 22 and 32 being engaged with each other with a phase difference of 180° therebetween. Grooves 22*a* and 32*a* are formed, respectively, along ridges of the stationary and movable spiral bodies 22 and 32 extending the spiral direction thereof. As shown in the enlarged view of seal 32*b* in FIG. 7, tip seal elements 22*b* and 32*b*, shown in FIG. 6, are accommodated in the grooves 22*a*, 32*a*, respectively, for sealing the gap between the spiral bodies 22, 32 and the side plates 31, 21.

As shown in FIG. 6, the rotation of a drive shaft 54 is converted to an orbital motion of the movable scroll member 53 through an eccentric bush 57 and an anti-spin mechanism 58. The structures and functions of the eccentric bush and the anti-spin mechanism are described in detail in, for example, Japanese Unexamined Patent Publication (Kokai) No. 57-148087 or 57-148092. According to the orbital motion of the movable scroll member 53, a volume of a compression chamber 55 formed between the scroll members 52, 53 is gradually decreased while the compression chamber 55 is displaced to a central area of the scroll members, whereby a fluid in the compression chamber 55 is compressed and finally discharged therefrom through a discharging port 61 of the stationary side plate 21, into a discharging chamber 60. At this stage, the tip seal element 32*b* is pressurized from the back by a coolant gas from a high pressure side HP positioned closer to the center of the stationary side plate 21, whereby the tip seal element 32 is brought into tight contact with a wall of the groove 32*a* adjacent to the low pressure side LP positioned farther from the center of the stationary side plate 21, and brought into tight contact with a surface of the stationary side plate 21 via a film of lubricant contained in the coolant gas, so that the coolant gas is sealed in the compression chamber 55. The tip seal element 22*b* functions in a similar manner.

In the conventional compressor, the tip seal element 32*b* is not provided in the beginning area, i.e., the radially inner extremity, of the movable spiral body 32. This is because, as shown in FIG. 8, the discharging port 61 of the conventional compressor has a circular shape, and if the tip seal element 32*b* were located in this area, the tip seal element 32*b* would be liable to be sucked from the groove 32*a* into the discharging port 61 when the tip seal element 32*b* overlapped the discharging port 61 in the course of the orbital motion of the movable scroll member 53, whereby the tip seal element 32*b* would be damaged by the edge of the latter. Accordingly, the conventional compressor has a drawback of an incomplete sealability at the beginning area of the movable spiral body, and as this area is subjected to the maximum pressure during the compression process, a pressure loss is liable to occur.

SUMMARY OF THE INVENTION

The object of the present invention is to solve the above drawback of the prior art and to improve the sealability at the beginning area of the movable spiral body while preventing the damage of the tip seal element.

According to the present invention, a scroll type compressor is proposed, comprising a stationary scroll member consisting of a stationary side plate and a stationary spiral body integrally fixed therewith and a movable scroll member consisting of a movable side plate and a movable spiral body integrally fixed therewith; both the scroll members being engaged with each other so that a plurality of compression chambers are formed between the scroll members and gradually decreased during an orbital motion of the movable scroll member around the stationary scroll member, while the movable scroll member is inhibited from spinning on its own axis, whereby a fluid is compressed in the compression chambers and discharged from the compression chamber through a discharging port formed on the stationary side plate; the movable spiral body having a groove along a ridge thereof, extending in the spiral direction, in which groove a tip-seal element is accommodated for sealing a gap between the stationary side plate and the ridge of the movable spiral body; characterized in that the tip-seal element extends to the beginning area of the movable spiral body and in that the discharging port is formed in an elongated shape to thereby avoid an interference thereof with the tip-seal element during the orbital motion of the movable scroll member while a necessary cross-sectional area of the discharging port is maintained.

According to the present invention, the sealability is fully maintained even at the beginning area of the movable spiral body subjected to the maximum pressure, because the tip-seal element is extended thereto, and thus a pressure loss in the compression chamber is avoided.

Moreover, as the discharging port is formed in an elongated shape, not in a circular shape, so that the interference thereof with the tip-seal element can be avoided and that the necessary cross-sectional area of the discharging port is maintained, a draw-in of the tip seal element from the groove to the discharging port is prevented and damage to the tip-seal element by the edge of the discharging port is avoided, while the necessary discharging efficiency is guaranteed.

BRIEF DESCRIPTION OF THE DRAWINGS

Other and further objects and advantages of the present invention will be apparent from the following description of the preferred embodiments with reference to the attached drawings: wherein.

DESCRIPTION OF THE PREFERRED EMBODIMENTS

Figure 1:
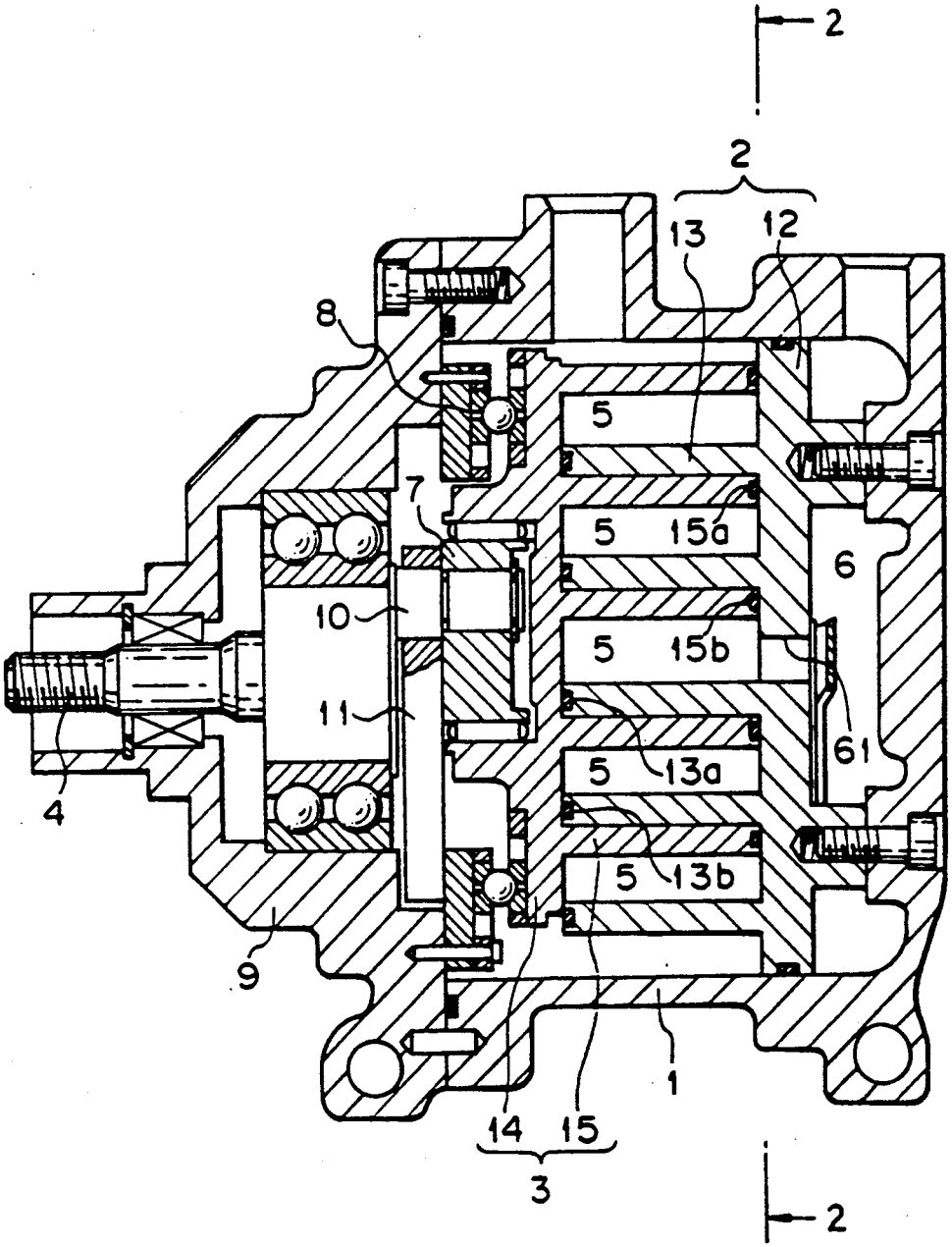
FIG. 1 is a side sectional view of a scroll type compressor according to the present invention.

As shown in FIG. 1, in a scroll type compressor according to the present invention, a stationary scroll member 2 is fixed within a housing 1, and a movable scroll member 3 arranged in the housing 1 and a housing 9 is engaged with the stationary scroll member 2 so that a plurality of compression chambers 5 are formed between both the scroll members 2 and 3. A drive shaft 4 is supported in the housings 1, 9 via a bearing means, and an eccentric pin 10 is secured on an inner end surface of the driving shaft 4. At the bearing side end of the eccentric pin 10 is fixed a counterweight 11, and to the other end thereof is attached a driving bush 7 supporting the movable scroll member 3 by a bearing means, so that it can be subjected to an orbital motion around the stationary scroll member 2 in association with an anti-spin mechanism 8.

Figure 2:
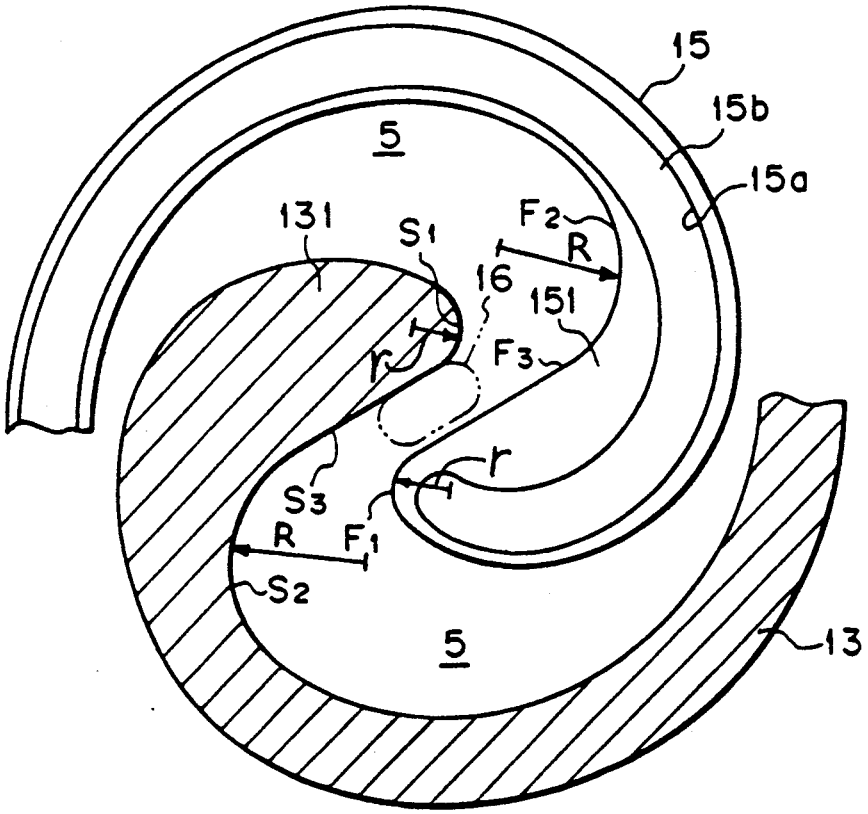
FIG. 2 is a section as seen from line 2—2 in FIG. 1 at a certain phase angle of the orbital motion of the movable scroll member.

The movable scroll member 3 consists of a movable side plate 14 and a movable spiral body 15 integrally fixed therewith on one side of the side plate 14. As shown in FIG. 2, the movable spiral body 15 is formed by outer and inner walls, each defined, except for the beginning area 151 thereof, by an involute curve obtained from a predetermined basic circle. Only the inner wall of the beginning area 151 is defined by an arc $F_1$ having a radius r, an arc $F_2$ having a radius R (r+radius of orbital motion) and a common tangent $F_3$ for the two arcs. Along a ridge of the movable spiral body 15 is extended a groove 15*a*, from the beginning area 151 to the ending area thereof (not shown), while an equal wall thickness is maintained between the groove and the outer wall of the spiral body 15. A tip-seal element 15*b* made of PTFE (polytetrafluoroethylene) is accommodated within the groove 15*a*, for sealing a gap between the stationary side plate 12 and the tip end of the spiral body 15. A more detailed explanation will be made later of the tip-seal element.

As shown in FIG. 1, the stationary scroll member 2 consists of a stationary side plate 12 and a stationary spiral body 13 integrally fixed therewith on one side of the side plate 12. As shown in FIG. 2, the stationary spiral body 13 is formed by outer and inner walls, each defined, except for the beginning area 131 thereof, by an involute curve obtained from a predetermined basic circle. Only the inner wall of the beginning area 131 is defined by an arc $S_1$ having a radius r, an arc $S_2$ having a radius R (r+radius of orbital motion) and a common tangent $S_3$ for the two arcs. Along a ridge of the stationary spiral body 13 is also extended a groove 13*a*. A tip-seal element 13*b* made of PTFE (polytetrafluoroethylene) is accommodated within the groove 13*a*, for sealing a gap between the movable side plate 14 and the tip end of the spiral body 13. This tip seal element 13*b* is provided in the beginning area 131 (although not shown in the drawing), as in the case of the tip seal element 15*b* for the stationary spiral body 15.

As shown in FIG. 2, an oval shaped discharging port 16 is formed in the stationary plate 12, having the same cross-sectional area as that of the conventional discharging port of a circular shape and located at a position where it will not interfere with the tip seal element 15*b* during the orbital motion of the movable scroll member 3. The discharging port 16 has a longitudinal edge starting from a border of the arc $S_1$ and the common tangent $S_3$ and extending along the common tangent $S_3$.

Figure 3:
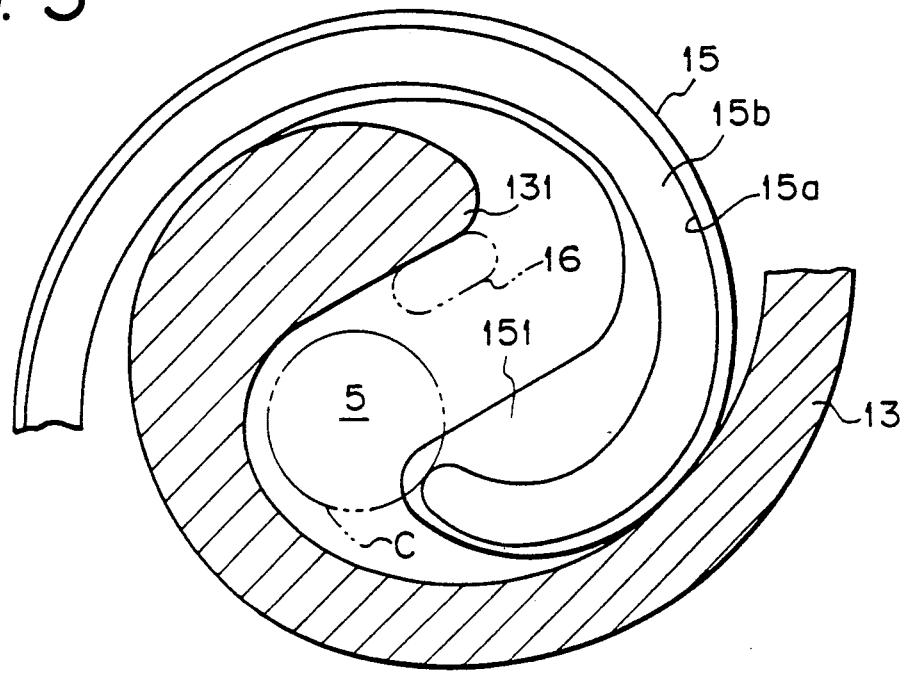
FIG. 3 is a similar section of FIG. 1 at a phase angle advanced by 90° from that shown in FIG. 2.
Figure 4:
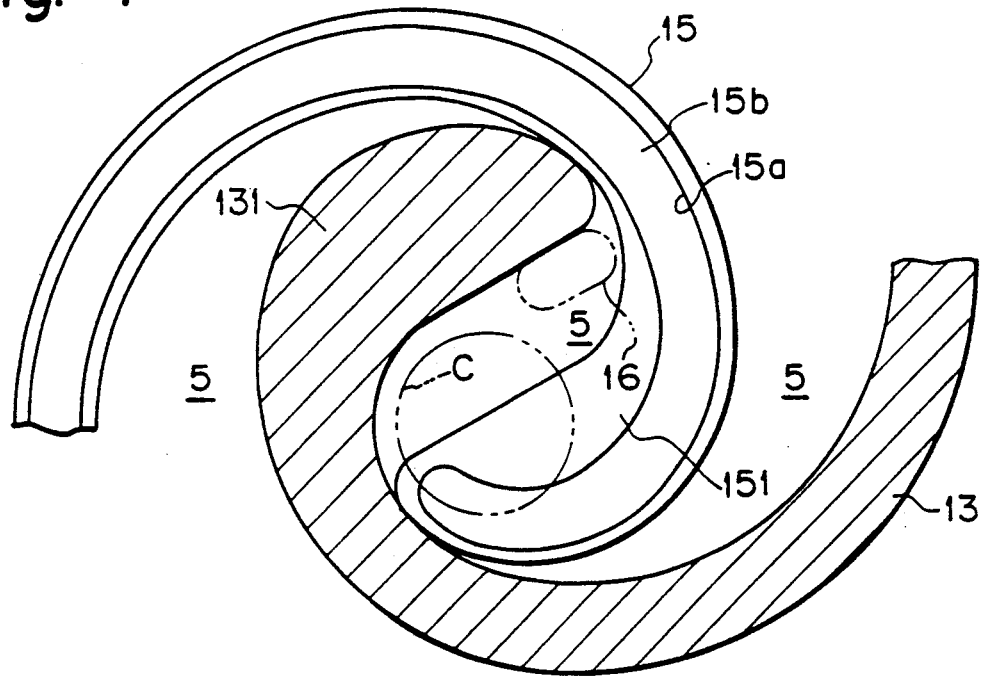
FIG. 4 is a similar section of FIG. 1 at a phase angle advanced by 90° from that shown in FIG. 3.
Figure 5:
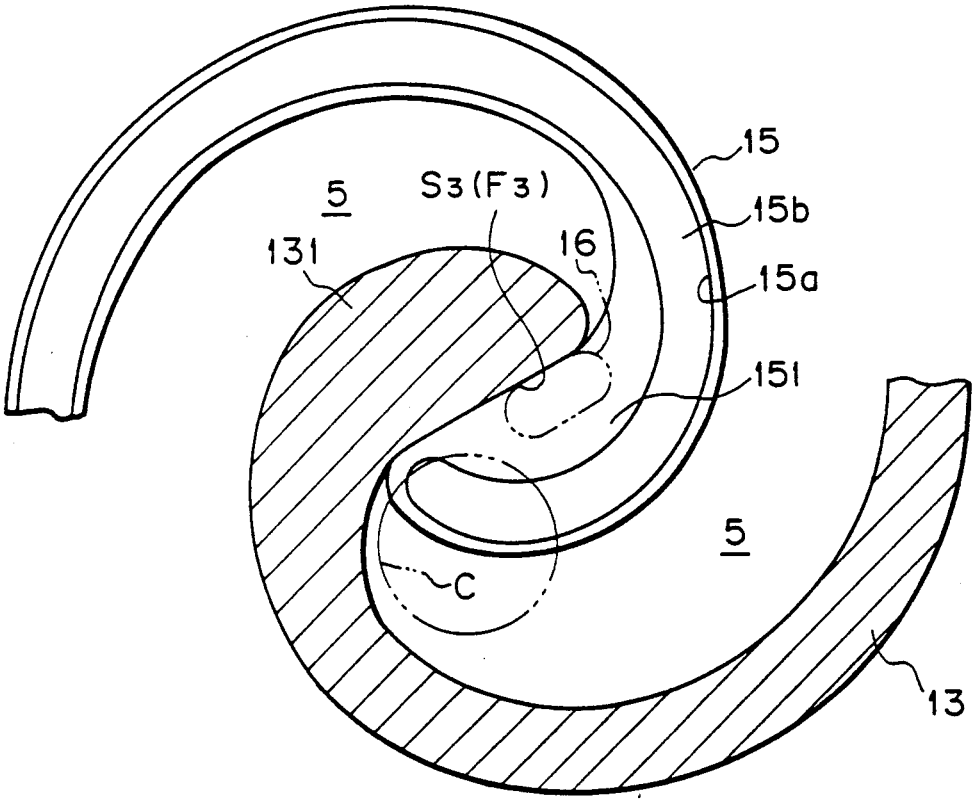
FIG. 5 is a similar section of FIG. 1 at a phase angle advanced by 90° from that shown in FIG. 4.
Figure 6:
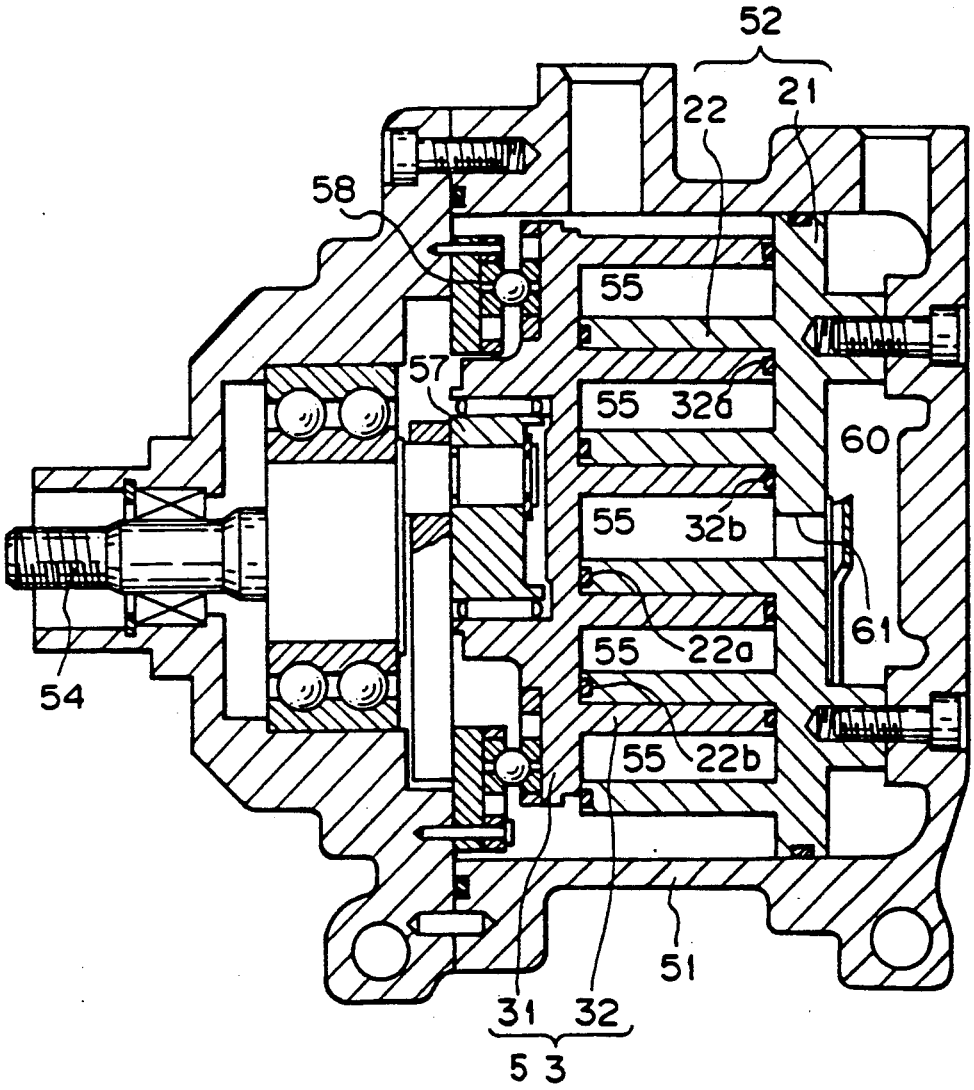
Fig. 6 PRIOR ART
FIG. 6 is a side sectional view of a conventional scroll type compressor.
Figure 7:
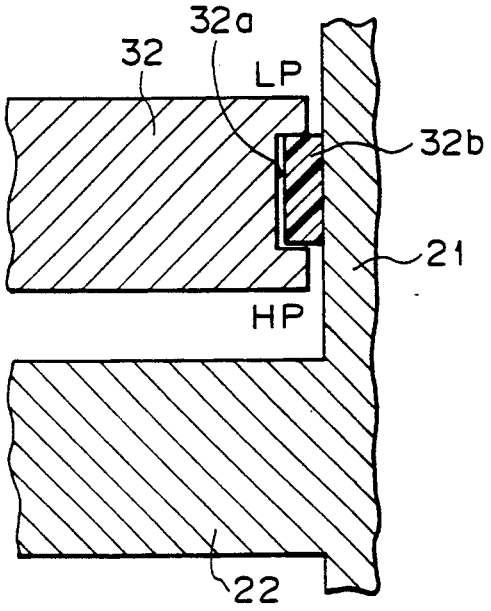
Fig. 7 PRIOR ART
FIG. 7 is an enlarged side sectional view of a main portion of the conventional compressor.
Figure 8:
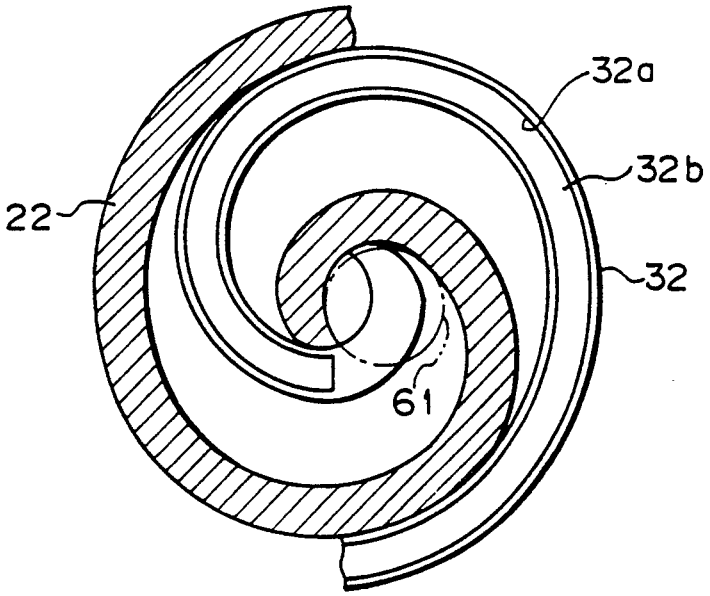
Fig. 8 PRIOR ART
FIG. 8 is a cross-section of a main portion of a conventional compressor.

According to this type of compressor, the rotation of the drive shaft 4 is converted to an orbital motion of the movable scroll member 3 through the eccentric pin 10, by means of the driving bush 7 and the anti-spin mechanism 8. At a certain stage of this orbital motion, the movable scroll member 3 (movable spiral body 15) occupies a position as shown in FIG. 2 and then is displaced therefrom to another position shown in FIG. 3, advanced by a phase angle of 90°, around a center of the orbital motion not shown. At this position, a pair of compression chambers 5, 5 are united to form a single compression chamber. The tip-seal element 15*b* does not interfere with the discharging port 16 and suitably seals the single compression chamber 5. The compression chamber 5 is contracted more and more when the movable scroll member 3 occupies a position shown in FIG. 4 by a further displacement thereof by a phase angle of 90° from the position shown in FIG. 3. At this stage, the tip-seal element 15*b* approaches closer to the discharging port 16 but does not interfere with the discharging port 16 and maintains a suitable sealing of the gradually contracted compression chamber 5. Upon a further advance of the orbital motion by a phase angle of 90°, the movable scroll member 3 occupies a position shown in FIG. 5, at which a volume of the single compression chamber 4 becomes almost zero. The longitudinal edge of the discharging port 16 along the common tangent $S_3$ of the stationary spiral body 13 lies adjacent to the common tangent $F_3$ of the movable spiral body 15, so that the discharging port 16 is substantially completely blocked by the beginning area 151 of the movable spiral body 15. Although the tip-seal element 15*b* comes very close to the discharging port 16, it does not yet interfere with the discharging port 16. Upon further rotation of the movable scroll member 3, the tip-seal element 15*b* is moved farther from the discharging port 16, and thereafter the above steps are repeated.

Thus, as the volume of the compression chamber 5 decreases during the orbital motion of the movable scroll member 3, a coolant gas in the compression chamber 5 is pressurized to a pressure value identical to that of the conventional compressor, and the pressure thereof opens a valve (not shown) so that the gas is discharged from the discharging port 16 with the same cross-sectional area as that of the conventional circular one to a discharging chamber 6. The tip-seal element 13*b* in the stationary spiral body 13 operates in association with the movable side plate 14, in the same manner as the tip-seal element 15*b*, relative to the stationary side plate 12 as stated above.

In the scroll type compressor according to the present invention, since the tip-seal elements 13*b* and 15*b* are provided even at the beginning area of the stationary and movable spiral bodies 13 and 15 subjected to the maximum pressure in the course of the compression stroke, the sealability in this area is improved and pressure loss prevented.

As the discharging port 16 has an oval shape, to avoid an interference thereof with the tip-seal element 15*b* in the course of the orbital motion of the movable scroll member 3, the tendency for the tip-seal element 15*b* to be drawn from the groove 15*a* into the discharging port 16, and thus to be damaged by the edge thereof, is eliminated. Further, the fluid pressure is maintained at the same level as in the case of the conventional circular discharging port, because the cross-sectional areas thereof are the same.

Accordingly, in this compressor, the leakage of the coolant gas is suppressed to a minimum value so that the drive force can be effectively utilized. Also, the life span of the tip-seal element can be prolonged due to the elimination of the damage by the discharging port.

In this connection, the discharging port 16 is not limited to an oval but may be any shape, provided it is an elongated shape.

Another advantage of the present invention is as follows:

In this compressor, the tip-seal element is provided throughout the length of each of the stationary and movable spiral bodies, whereby the sealability between the stationary and movable scroll members can be suitably maintained even though a certain axial gap is formed therebetween, to avoid a direct contact of the two scroll members. This results in a reduction of the drive power and an improvement of the durability, due to a prolonging of the life span of the parts.

We claim:

1. A scroll type compressor comprising:

a stationary scroll member comprising a stationary side plate and a stationary spiral body integral therewith; and a movable scroll member comprising a movable side plate and a movable spiral body integral therewith;

said stationary and movable scroll members being engaged with each other so that a plurality of compression chambers are formed therebetween which chambers gradually decrease in volume to compress fluid therein during an orbital revolution of the movable scroll member around the stationary scroll member during which the movable scroll member is inhibited from rotating on its own axis;

said stationary side plate having a discharging port for discharging compressed fluid from said compression chambers, said movable spiral body comprising a ridge projecting from said movable side plate and extending spirally parallel to said movable side plate, said ridge having a top surface into which is formed a groove that extends along the ridge, and a tip-seal element mounted within and along said groove for engaging said stationary side plate, said tip seal element and accommodating groove extending throughout the length of said ridge up to the radially inner extremity of said ridge to provide a substantially fluid-tight seal between said stationary side plate and said movable spiral body; and said discharging port having an elongated cross-section and being disposed in said stationary side plate adjacent the radially inner extremity of said stationary spiral body at a location that avoids interference with said tip-seal element during said orbital revolution of the movable scroll member.

2. A scroll type compressor according to claim 2, wherein said stationary spiral body comprises a stationary ridge projecting from said stationary side plate and extending spirally parallel to said stationary side plate, and both said ridges have radially outer and inner walls, each of said walls describing an involute curve except for a respective section at the radially inner extremity of said inner walls, each said section being defined by a small arc having a radius r, a large arc having a radius (r + the radius of orbital revolution), and a tangent common to said arcs.

3. A scroll type compressor according to claim 2, wherein said discharging port is positioned in said stationary side plate so that an elongated edge of said port is adjacent and parallel to said common tangent section of said inner wall of said stationary ridge.

4. A scroll type compressor according to claim 1, wherein said tip-seal element is made of polytetrafluoroethylene resin.

* * * * *

UNITED STATES PATENT AND TRADEMARK OFFICE

CERTIFICATE OF CORRECTION

PATENT NO. : 5,217,358
DATED : June 8, 1993
INVENTOR(S) : T. Mori

It is certified that error appears in the above-indentified patent and that said Letters Patent is hereby corrected as shown below:

Column 1, line 3, "PART" should read --PORT--; line 29, after "32" insert comma --,--.

Column 6, line 26, after "claim" change "2," to --1,--.

Signed and Sealed this

Eighteenth Day of January, 1994

*Attest:*

*Attesting Officer*

BRUCE LEHMAN

*Commissioner of Patents and Trademarks*